US006858787B1

(12) United States Patent
de Vries

(10) Patent No.: US 6,858,787 B1
(45) Date of Patent: Feb. 22, 2005

(54) CONTAINER

(75) Inventor: Stefan de Vries, Dandenong (AU)

(73) Assignee: Cool Plastics Pty Ltd., Bayswater (AU)

( * ) Notice: Subject to any disclaimer, the term of this patent is extended or adjusted under 35 U.S.C. 154(b) by 0 days.

(21) Appl. No.: 10/048,656

(22) PCT Filed: Feb. 8, 2000

(86) PCT No.: PCT/AU00/00911

§ 371 (c)(1),
(2), (4) Date: Feb. 1, 2002

(87) PCT Pub. No.: WO01/09005

PCT Pub. Date: Feb. 8, 2001

(30) Foreign Application Priority Data

Aug. 3, 1999 (AU) ..... PQ1991

(51) Int. Cl.[7] ..... G10D 13/08
(52) U.S. Cl. ..... 84/402; 84/410
(58) Field of Search ..... 84/402, 406, 410, 84/403, 408

(56) References Cited

U.S. PATENT DOCUMENTS 4,721,232 A * 1/1988 Federighi ..... 222/196.5
5,212,331 A * 5/1993 Waldo ..... 84/404
5,265,514 A * 11/1993 Schertz ..... 84/422.4
5,312,282 A 5/1994 Cooper ..... 446/27
5,483,859 A * 1/1996 Singer ..... 84/322
5,659,143 A * 8/1997 Isackson ..... 84/402
5,808,215 A * 9/1998 Kralik et al. ..... 84/402
D428,656 S 7/2000 Alexander et al. ..... D24/197
6,288,314 B1 * 9/2001 Cohen et al. ..... 84/402
6,365,810 B1 * 4/2002 Enhoffer et al. ..... 84/402
6,512,169 B1 * 1/2003 Santini ..... 84/402
6,555,736 B1 * 4/2003 Delosreyes ..... 84/402

FOREIGN PATENT DOCUMENTS

FR 616581 10/1926

* cited by examiner

*Primary Examiner*—Kimberly Lockett
(74) *Attorney, Agent, or Firm*—Baker & Daniels

(57) ABSTRACT

A container (10) includes two chambers (14, 20). The main chamber (14) can receive the beverage. The other chamber (20) receives percussion means (not illustrated) such as ball bearings. The container can also include handle (11). The two chambers (14, 20) together with the handle (11) form the shape of a maraca.

26 Claims, 2 Drawing Sheets

CONTAINER

TECHNICAL FIELD

The present invention relates to an improved type of container. The container is suitable for holding a beverage, but is not limited thereto.

BACKGROUND ART

According to French patent number 9513480 a champagne bottle has been modified to allow a musical device to be affixed to the base of the bottle.

The champagne bottle has a base which is recessed and the musical device is affixed to the bottom of the bottle in the recessed area, so that it does not affect the stability of the bottle when it is placed on a flat surface.

According to the French patent, the champagne bottle with the musical device affixed in the aforementioned manner, plays a pleasant tune when the bottle is lifted and tilted.

The present invention provides an alternative type of container which allows it to be used as a percussive instrument.

SUMMARY OF THE INVENTION

According to the present invention there is provided a container which includes:

a first chamber; and a second chamber for receipt of percussion means, which second chamber is sealed from the first chamber.

PREFERRED FEATURES OF THE INVENTION

It is preferred that the container further includes a neck portion which is adapted as a handle to permit the container to be shaken as a percussion instrument.

It is preferred that the container further includes percussion means which is confined in the second chamber.

It is preferred that the percussion means includes particulate matter confined to the second chamber and adapted to make a noise when the container is shaken.

Preferably the container is a bottle.

The container may be shaped like a maraca.

The first chamber may be located above the second chamber.

It is preferred that the first chamber and the second chamber together form an exterior surface of the container.

It is preferred that the container includes a bulbous lower end, which lower end includes the first chamber and the second chamber.

It is preferred that the first chamber occupies a major part of the lower end of the container.

The container preferably includes a first part including the first chamber and a second part including the second chamber.

It is preferred that the first part is removably connected to the second part.

It is preferred that the second part comprises a base portion which acts as a support for the first part.

It is preferred that the first part includes a connecting means.

The connecting means is preferably provided on a base portion of the first part.

According to one preferred form of the invention, the base portion is substantially flat. According to an alternative form of the invention, the base portion is substantially concave.

According to one embodiment the base portion has a rim for supporting the first part when the first part is not connected to the second chamber.

The second part preferably includes a coupling means which is adapted to couple to the connection means of the first part.

According to one particularly preferred form of the invention, the connection means includes a downwardly directed protrusion which is adapted to connect with a female portion of the coupling means of the second part. According to this form of the invention, the first part is preferably adapted to be screwed onto the second part or vice versa.

According to another particularly preferred form of the invention, the connection means includes a structure which is a snap fit with a complementary structure on the second part.

The second chamber may be sealed.

The particulate matter preferably includes at least one of ball bearings, plastic beads and ceramic beads.

The second part preferably includes an upper surface which is adapted to abut a lower surface of the first part.

It is preferred that the second part is permanently affixed to the first part.

A preferred embodiment of the present invention will now be described by way of example only with reference to the accompanying drawings.

DESCRIPTION OF PREFERRED EMBODIMENTS OF THE INVENTION

Figure 1:
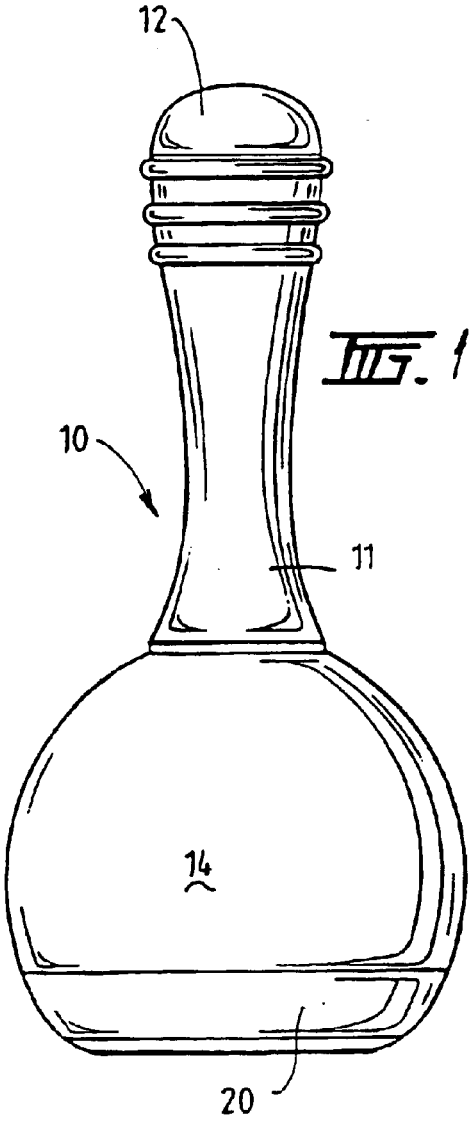
FIG. 1 shows a front view of a bottle according to the present invention
Figure 5:
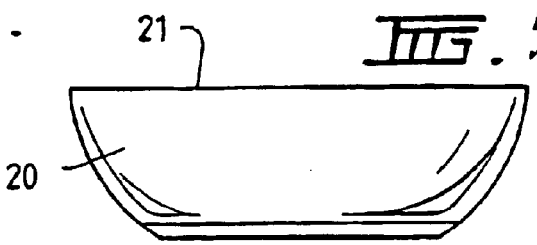
FIG. 5 shows a side view of the second part.
Figure 4:
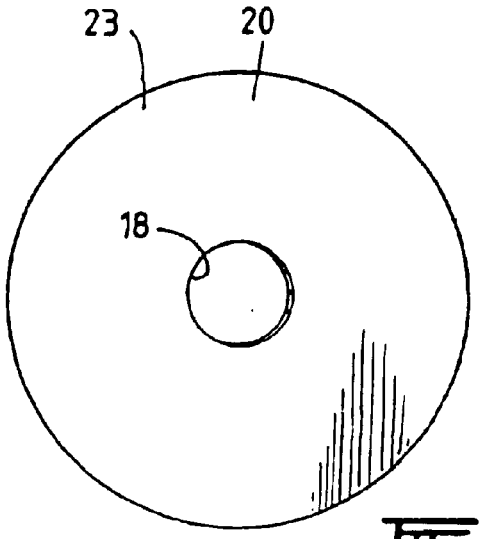
FIG. 4 shows a top view of the second part.

As shown in FIG. 1 a bottle in accordance with the preferred embodiment is shaped like a maraca.

The handle 11 of the bottle 10 flares upwardly and outwardly. A screw-on cap 12 may be fitted to the mouth of the bottle 10.

The neck 11 of the bottle 10 extends upwardly from a generally round shaped main chamber 14.

Figures 2, 3, 7:
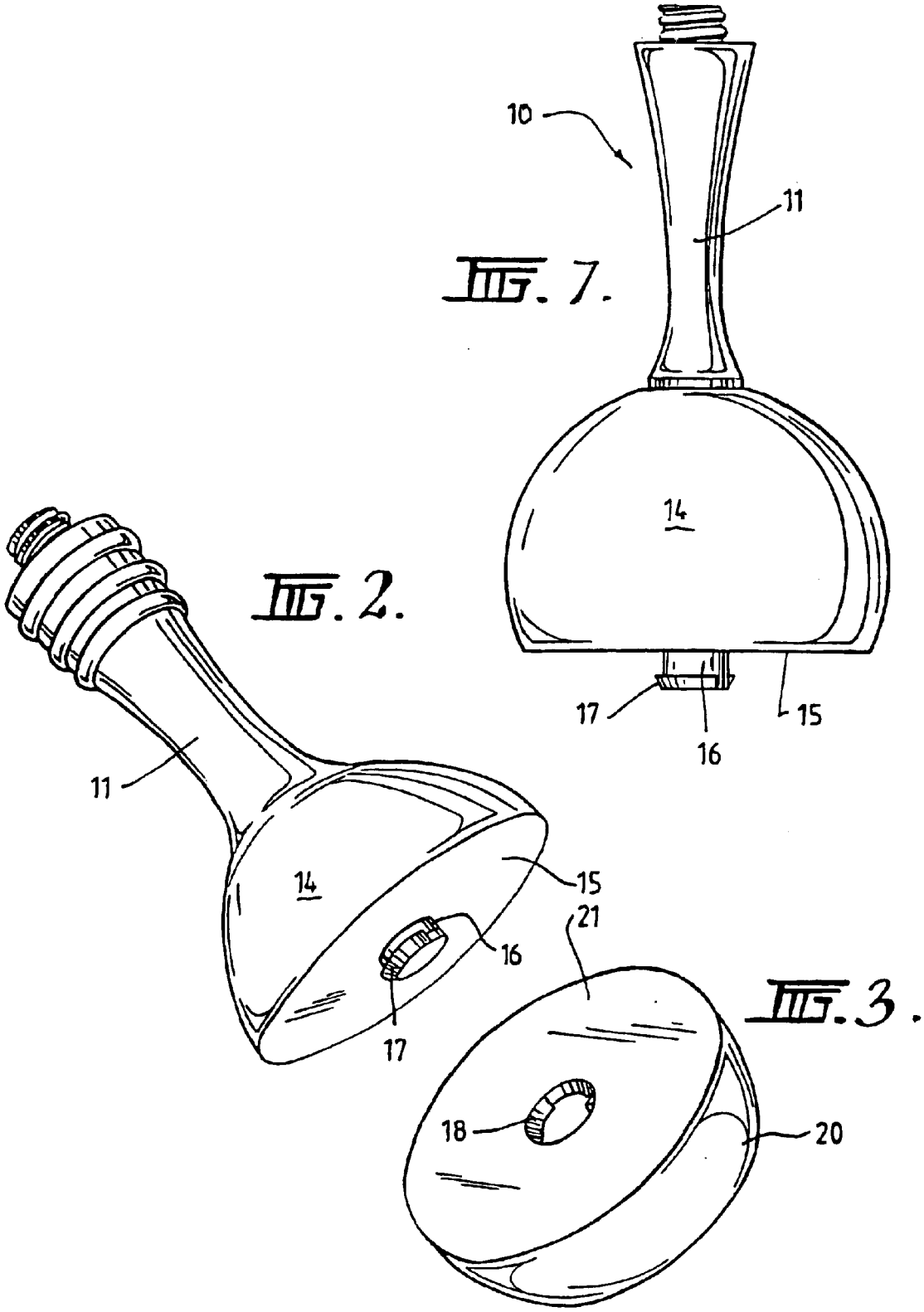
FIG. 2 shows an angled front view of a first part of the bottle shown in FIG. 1.
FIG. 3 shows an angled top view of a second part of the bottle shown in FIG. 1.
FIG. 7 shows a front view of the first part according to another embodiment

The main chamber 14 has a base 15 as shown in FIG. 2.

A spigot 16 extends downwardly from the centre of this base 15 and is provided with an external thread 17.

The spigot 16 is adapted to screw into a hole 18 with threaded internal peripheral walls adapted to permit the spigot 16 to be screwed there into.

The percussion part 20 according to the present embodiment of the invention has a generally flat top surface 21 and has a generally bowl shaped outer peripheral surface with a slightly convex base 23.

According to an alternative preferred form of the invention which is not illustrated in the drawings, the base 15 and the percussion part 20 carry complementary structures which provide for a snap fit between the parts 15 and 20.

Percussion beads or ball bearings are adapted to be placed inside the hollow percussion part 20 and the percussion beads may be scaled off inside the percussion part 20 prior to attachment of the percussion part 20 to the spigot 16. Once the percussion part 20 is screwed onto the spigot 16 the two parts may be permanently connected together by suitably gluing the opposing faces 14 and 21 of the main chamber 14 and the percussion part 20.

Figure 6:
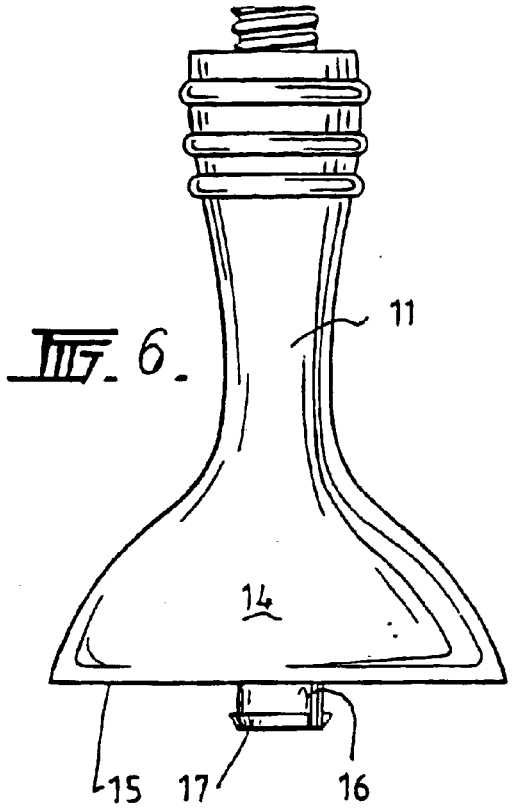
FIG. 6 shows a front view of the first part according to one embodiment of the present invention.

As shown in FIG. 7 and FIG. 6 the size of the main chamber may vary, with the main chamber being larger in the bottle of FIG. 7 compared to that of the bottle shown in FIG. 6.

It is intended that in use the bottle be filled with a beverage or other substance and that once the substance has been removed the bottle can then be shaken like a maraca. It is also possible that the bottle can be used as a maraca prior to removal of the contents from it. However it is preferred that the beverage is removed firstly to prevent accidental spillage of the beverage from within the container and secondly to ensure the best possible simulation of a maraca.

Variations may be made to the above described embodiment without departing from the overall concept. For example the percussion part of the bottle could be provided in the form of a specially shaped container which is merely stuck to the bottom of the bottle.

Furthermore the percussion part could be in the form of a ring which is attached to the outside of the main chamber of the bottle. The ring could be in the form of a toroid or similar shaped structure which may be placed over the neck of the bottle.

According to another variation of the present invention the bottle could be made with two chambers formed therein and a small hole to the chamber housing the percussion beads to enable the percussion beads to be placed therein.

Once the percussion beads are inside the percussion bead chamber, the small opening could then be sealed.

According to yet another embodiment of the invention which is not shown in the drawings, the cap 12 includes a teat for excretion of contents from the container.

Variations and modifications can be made in respect of the invention described above and defined in the following statement of claims.

What is claimed is:

1. A bottle including a first chamber and a second chamber, the second chamber being sealed from the first chamber and containing particulate matter, the first chamber containing a liquid therein and including a body portion and a neck portion having a removable closure at an open end thereof, the neck portion extending from the body portion and having a narrow profile with respect to the body portion, said neck portion defining a handle, whereby the neck portion may be grasped to allow the bottle to be shaken as a percussion instrument.

2. A bottle as claimed in claim 1 wherein the second chamber is located adjacent to the first chamber at an end of the body portion opposed to the neck portion.

3. A bottle as claimed in claim 2 wherein the first chamber and second chamber together form an exterior surface of the bottle.

4. A bottle as claimed in claim 1 wherein the body portion is formed into a substantially bulbous shape.

5. A bottle as claimed in claim 1 wherein the neck portion is tapered such that the perimeter of the neck portion is smaller near the end adjacent to the body portion than at the open end.

6. A bottle as claimed in claim 1 and which is shaped like a maraca.

7. A bottle as claimed in claim 1, further including a first part including the first chamber and a second part including the second chamber.

8. A bottle as claimed in claim 7 wherein the first part is removably connected to the second part.

9. A bottle as claimed in claim 7 wherein the second part includes a base portion which acts as a support for the first part.

10. A bottle as claimed in claim 7 wherein the first part includes a connecting means and wherein the connecting means is provided on a base portion of the first part.

11. A bottle as claimed in claim 10 wherein the base portion of the first part is substantially concave.

12. A bottle as claimed in claim 10 wherein the second part includes a coupling means which is adapted to couple to the connecting means of the first part.

13. A bottle as claimed in claim 12 wherein the connecting means includes a downwardly directed protrusion which is adapted to connect with a female portion of the coupling means of the second part.

14. A bottle as claimed in claim 10 wherein the connecting means includes a structure which is a snap fit with a complementary structure on the second part.

15. A bottle as claimed in claim 1 wherein the bottle includes a bulbous lower end, which lower end includes the second chamber and a large proportion of the first chamber.

16. A bottle as claimed in claim 15 wherein the large proportion of the first chamber occupies a major part of the bulbous lower end of the bottle.

17. A bottle as claimed in claim 1 wherein the particulate matter includes any one or more of ball bearings, plastic beads and ceramic beads.

18. A bottle, comprising:

a first section including a body portion and an elongate neck portion which together define a first hollow chamber, the elongate neck portion extending from the body portion and terminating in an open end having a removable closure screw threadingly connected to the open end; and a second section defining a second hollow chamber sealed from the first hollow chamber and containing particulate matter, the first and second sections having complementary outer surfaces which together form a semi-spherical shape the second section further having a substantially flat base wall.

19. A bottle as claimed in claim 18 further including a first part including the first section and a second part including the second section.

20. A bottle as claimed in claim 19 wherein the first part is removably connected to the second part.

21. A bottle as claimed in claim 19 wherein the first part includes a connecting means and wherein the connecting means is provided on a base portion of the first part.

22. A bottle as claimed in claim 21 wherein the base portion of the first part is substantially concave.

23. A bottle as claimed in claim 21 wherein the second part includes a coupling means which is adapted to couple to the connecting means of the first part.

24. A bottle as claimed in claim 23 wherein the connecting means includes a downwardly directed protrusion which is adapted to connect with a female portion of the coupling means of the second part.

25. A bottle as claimed in claim 21 wherein the connecting means includes a structure which is a snap fit with a complementary structure on the second part.

26. A bottle as claimed in claim 18 wherein the particulate matter includes any one or more of ball bearings, plastic beads and ceramic beads.

* * * * *

UNITED STATES PATENT AND TRADEMARK OFFICE

CERTIFICATE OF CORRECTION

PATENT NO. : 6,858,787 B1
DATED : February 22, 2005
INVENTOR(S) : Stefan de Vries It is certified that error appears in the above-identified patent and that said Letters Patent is hereby corrected as shown below:

Title page,
Item [75], Inventors, delete "Dandenong" and insert -- Ferntree Gully, Victoria, Australia --.

Item [73], Assignee, delete "Bayswater" and insert -- Brentford Square, Victoria, Australia --.

Signed and Sealed this

Twenty-fourth Day of May, 2005

JON W. DUDAS
*Director of the United States Patent and Trademark Office*